US009145690B2

(12) United States Patent
Stucky et al.

(10) Patent No.: US 9,145,690 B2
(45) Date of Patent: Sep. 29, 2015

(54) SYSTEM, METHOD AND APPARATUS FOR DARK-COLORED SIDING PANEL PRODUCT

(71) Applicant: CertainTeed Corporation, Valley Forge, PA (US)

(72) Inventors: David J. Stucky, Grass Lake, MI (US); Randall M. Elinski, Jackson, MI (US); Lori M. Hesslau, Jackson, MI (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 14/178,495

(22) Filed: Feb. 12, 2014

(65) Prior Publication Data

US 2014/0227478 A1 Aug. 14, 2014

Related U.S. Application Data

(60) Provisional application No. 61/764,272, filed on Feb. 13, 2013.

(51) Int. Cl.

| | |
|---|---|
| ***B32B 7/02*** | (2006.01) |
| ***B32B 3/06*** | (2006.01) |
| ***B32B 27/00*** | (2006.01) |
| ***E04D 1/00*** | (2006.01) |
| ***E04C 1/00*** | (2006.01) |
| ***E04F 13/08*** | (2006.01) |
| ***E04F 13/12*** | (2006.01) |

(52) U.S. Cl.

CPC ..... *E04F 13/0866* (2013.01); *E04F 13/0864* (2013.01); *E04F 13/0876* (2013.01); *E04F 13/12* (2013.01); *Y10T 428/24008* (2015.01); *Y10T 428/2495* (2015.01); *Y10T 428/24942* (2015.01); *Y10T 428/249992* (2015.04); *Y10T 428/263* (2015.01); *Y10T 428/264* (2015.01); *Y10T 428/269* (2015.01); *Y10T 428/3192* (2015.04)

(58) Field of Classification Search

None

See application file for complete search history.

(56) References Cited

U.S. PATENT DOCUMENTS

| | | | | |
|---|---|---|---|---|
| 6,827,995 | B2 | 12/2004 | Hughes et al. | |
| 6,872,438 | B1 | 3/2005 | Allgeuer | |
| 6,946,182 | B1 | 9/2005 | Allgeuer | |
| 2001/0041256 | A1 | 11/2001 | Heilmayr | |
| 2005/0153122 | A1 * | 7/2005 | Detterman | 428/304.4 |
| 2006/0013994 | A1 | 1/2006 | Burke | |

(Continued)

FOREIGN PATENT DOCUMENTS

| | | | |
|---|---|---|---|
| WO | 9922092 | A1 | 5/1999 |
| WO | 2005070670 | A1 | 8/2005 |

(Continued)

OTHER PUBLICATIONS

Technical Search, 4 pgs, Sep. 2012.

*Primary Examiner* — David Sample
*Assistant Examiner* — Nicole T Gugliotta
(74) *Attorney, Agent, or Firm* — Abel Law Group, LLP; Alexander H. Plache

(57) ABSTRACT

A dark-colored siding panel product includes a shell having a layered structure. The layered structure can include a substrate comprising polyvinylchloride. The substrate may be located between inner and outer layers. The inner and outer layers may be formed from a weatherable polymer. In addition, at least the outer layer may have a CIE color unit L*<75. An insulation layer may be mounted to the shell.

20 Claims, 3 Drawing Sheets

(56) References Cited

U.S. PATENT DOCUMENTS

| | | | | |
|---|---|---|---|---|
| 2007/0119107 | A1 * | 5/2007 | Shaw et al. | 52/287.1 |
| 2012/0285109 | A1 * | 11/2012 | Mollinger et al. | 52/302.4 |

FOREIGN PATENT DOCUMENTS

| | | | | |
|---|---|---|---|---|
| WO | 2012009329 | A1 | 1/2012 | |
| WO | WO 2012/009329 | A1 * | 1/2012 | B32B 27/08 |

* cited by examiner

SYSTEM, METHOD AND APPARATUS FOR DARK-COLORED SIDING PANEL PRODUCT

This application claims priority to and the benefit of U.S. Prov. App. No. 61/764,272, filed Feb. 13, 2013, and is incorporated herein by reference in its entirety.

BACKGROUND OF THE INVENTION

1. Field of the Disclosure

The present invention relates in general to building products and, in particular, to a system, method and apparatus for a dark-colored siding panel product.

2. Description of the Related Art

Polyvinylchloride (PVC) is commonly used as house siding, trim, decking and fencing. Because of its good weathering properties, low cost and ease of installation, PVC has gained wide acceptance as a construction material. However, because of the thermal properties of PVC, darker colored vinyl siding may have limited application due to solar absorption. Some climates and field conditions can create situations resulting in heat distortion, buckling or curling. Vinyl siding is used mainly in moderate climates, such as the northern and eastern states of the United States. The use of PVC is typically avoided in hot climates, such as the southwestern states of the United States.

Dark colors typically absorb more energy from the sun and can cause the temperature of the siding to exceed the useable temperature range of PVC. Most manufacturers attempt to minimize potential heat gain by using infrared (IR) reflective pigments, and/or limiting their color offerings to light to medium colors. Some manufacturers have adopted chlorinated PVC (CPVC) and other materials over PVC to address these thermal issues. However, consumers and builders would like the option of using dark colors for some structures. Thus, it would be desirable to have a darker colored, weather resistant product that could withstand greater temperatures, be used in warmer climates, and which could withstand reflective heat.

SUMMARY

Embodiments of a system, method and apparatus for a dark-colored siding panel product are disclosed. For example, a siding panel product may include a shell having a layered structure. The layered structure can include a substrate comprising polyvinylchloride (PVC). The substrate may be located between inner and outer layers. The inner and outer layers may be formed from weatherable acrylic and styrenic-based thermoplastics, such as acrylonitrile styrene acrylate or poly(acrylic styrene acrylonitrile) (ASA), poly (acrylonitrile ethylene styrene) or poly(acrylonitrile ethylene propylene styrene) (AES), acrylic or polymethylmethacrylate (PMMA), etc. In addition, at least the outer layer may have a CIE color unit L*<75. An insulation layer may be mounted to the shell.

Other embodiments of a foamback siding panel product may comprise a shell having a co-extruded, 3-layered structure. The structure may include a substrate consisting of PVC located between inner and outer layers. Each of the inner and outer layers may consist of ASA. In addition, at least the outer layer may have a CIE color unit L*<60. An insulation layer comprising a foam material may be mounted to the shell.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

PVC alternatives in the capstock layer address color hold performance issues (i.e., fade) with mid-range to dark colors. PVC capstock alternatives include weatherable acrylic and styrenic-based thermoplastics, such as acrylonitrile styrene acrylate or poly(acrylic styrene acrylonitrile) (ASA), poly (acrylonitrile ethylene styrene) or poly(acrylonitrile ethylene propylene styrene) (AES), acrylic or polymethylmethacrylate (PMMA), provide enhanced weathering performance. The thermal properties of PVC and alternative polymers are significantly different. For example, PVC has a glass transition temperature (Tg) of about 165° F., and a coefficient of thermal expansion (CLTE) of about $3.5\times10^{-5}$, whereas ASA has a Tg of about 205° F., and a CLTE of about $5\times10^{-5}$. Accordingly, the heating, cooling, and forming of the product during manufacture, as well as the heating/cooling of the product in the field, create stresses that can result in permanent deformation when the product is exposed to elevated temperatures.

For many colors the distortion can be managed either by increasing the heat distortion temperature (HDT) of the polymer or by minimizing the heat build-up (HBU) of a given color. There has been some success in reducing thermal distortion via HBU reduction, HDT increase, and part design constraints in traditional hollow back vinyl siding products. However, heat distortion issues still persist for some darker colors that develop heat gain above the Tg of PVC.

For foam-backed vinyl siding products, buckling resistance may be improved by adhering foam to the back of the panel face. However, while buckling resistance has been improved with adhered foam, the product also realizes an increased heat gain of about 15° F. to bout 20° F. above that of a hollow back product. Foam-backed products typically refrain from oilcan buckling due to the adhesive bond to the foam. Once temperatures exceed PVC's Tg, portions of the vinyl shell that are not adhered to the foam will tend to curl and deform. When temperatures exceed the Tg of the pressure-sensitive adhesive, the adhesive may lose the bond strength necessary to restrain shell movement, which may result in delamination. While a thermosetting adhesive has been proposed as a solution to address the adhesive bond for increased HDT for dark colored insulated siding, this is not the complete solution, as it does not address the issue of thermal distortion at the laps or portions of the shell that are not adhered to the foam. It is desired to have a vinyl shell that is enhanced to resist distortion due to the bi-layer thermal property imbalance.

Figure 1:
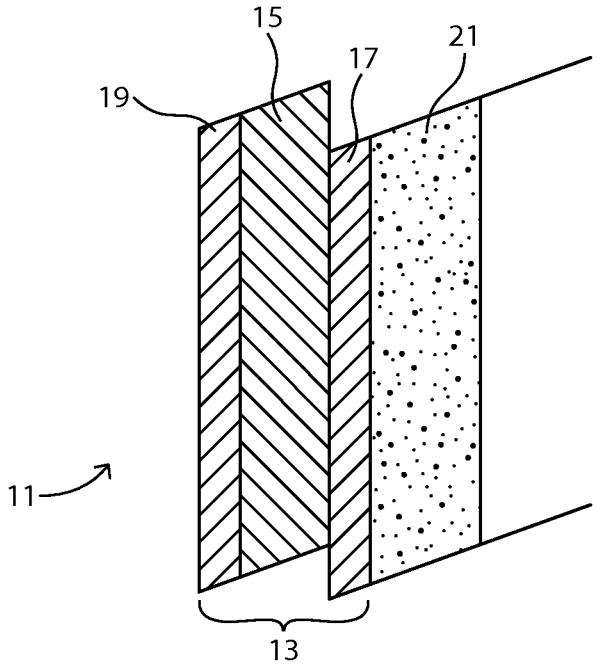
FIG. 1 is a schematic sectional view of an embodiment of siding.

Embodiments of a system, method and apparatus for dark-colored siding panel products are disclosed. For example, as shown in FIG. 1, a siding panel product 11 may comprise a shell 13 having a layered structure. The shell 13 may be configured as a 3-layered structure having no other layers, in some versions. Embodiments of the layered structure of the shell may be co-extruded. The layered structure may include a substrate 15 and inner and outer layers 17, 19, respectively. An insulation layer 21 may be mounted to the shell 13, such as adjacent to inner layer 17. The insulation layer 21 may comprise a foam material, in some versions.

Some embodiments of substrate 15 may comprise polyvinylchloride (PVC). The PVC may comprise conventional PVC, without fillers or modification. Substrate 15 may be located or sandwiched between the inner and outer layers 17, 19. The inner and outer layers 17, 19 may be formed from weatherable acrylic and styrenic-based thermoplastics, such as acrylonitrile styrene acrylate or poly(acrylic styrene acrylonitrile) (ASA), poly(acrylonitrile ethylene styrene) or poly (acrylonitrile ethylene propylene styrene) (AES), acrylic or polymethylmethacrylate (PMMA), etc.

In addition, color may be expressed as a CIE color unit L* value having a range from zero (0), which is black, up to 100, which is pure white. Embodiments of at least the outer layer 19 may have a CIE color unit L*<75. In other embodiments, at least the outer layer 19 may have a CIE color unit L*<60, a CIE color unit L*<50, a CIE color unit L*<40, or even a CIE color unit L*<30. The CIE color unit L* also may be in a range between any of these values.

Embodiments of the siding panel product 11 may have a vertical heat build up (HBU) of at least about 50° F. Heat build up may be defined under ASTM D4803, which includes a standard test method for predicting both horizontal and vertical (e.g., wall) heat build up in PVC building products. Heat build up in PVC exterior building products due to absorption of the energy from the sun may lead to distortion problems. Heat build up is affected by the color, emittance, absorptance, and reflectance of a product. Generally, the darker the color of the product, the more energy is absorbed and the greater is the heat build up. However, even with the same apparent color, the heat build up may vary due to the specific pigment system involved. This test method allows the measurement of the temperature rise under a specific type heat lamp, relative to that of a black reference surface, thus predicting the heat build up due to the sun's energy. The test method allows prediction of heat build up of various colors or pigment systems, or both. This test method gives a relative heat build up compared to black under certain defined severe conditions but does not predict actual application temperatures of the product. These also will depend on air temperature, incident angle of the sun, clouds, wind velocity, insulation, installation behind glass, etc.

In other embodiments, the inner and outer layers 17, 19 may have a glass transition temperature greater than the substrate 15. In addition, the inner and outer layers 17, 19 may have a heat distortion temperature greater than the substrate 15.

Embodiments of the outer layer 19 may have a thickness that differs from a thickness of the inner layer 17, or they may be equal in thickness. For example, the outer layer 19 may be thicker than the inner layer 17. Alternatively, the inner layer 17 may be thicker than the outer layer 19. Embodiments of the outer layer 19 may have a thickness of about 0.003 inches to about 0.005 inches. Some embodiments of the inner layer 17 may have a thickness of about 0.0015 inches to about 0.0025 inches. Still other embodiments of the inner layer 17 may have a thickness of about 0.001 inches to about 0.003 inches. In other examples, the shell 13 may have a total thickness of about 0.004 inches to about 0.060 inches, about 0.035 inches to about 0.050 inches, or about 0.042 inches to about 0.048 inches.

Some embodiments of the siding panel product 11 may include the inner layer 17 is a film or a coating. For example, the inner layer 17 may be applied as a wet coating. The wet coating may dry to a dry thickness of about 0.001 inches to about 0.002 inches, in some versions. Alternatively or in addition, the outer layer 19 may be applied as a wet coating. Such a wet coating may dry to a dry thickness of about 0.001 inches to about 0.002 inches.

Figure 2:
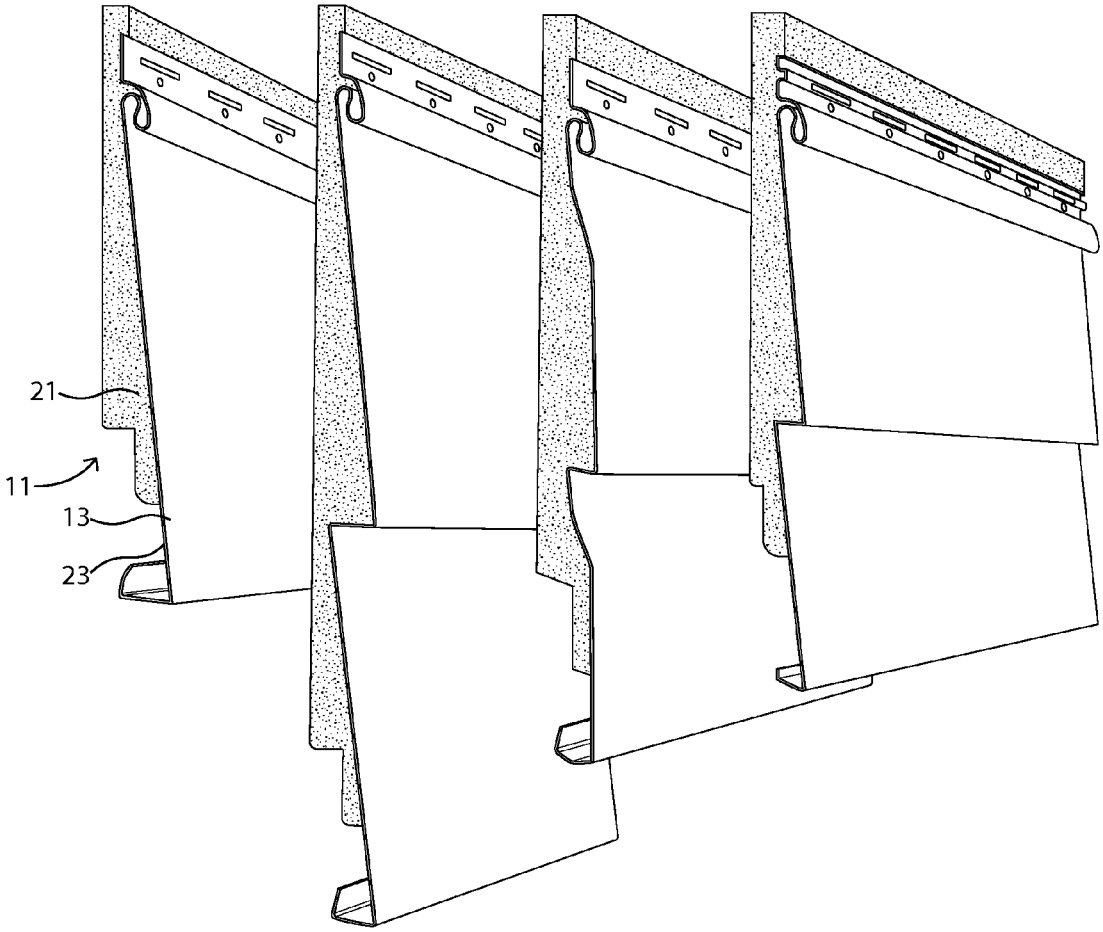
FIG. 2 is an isometric view of embodiments of siding.
Figure 3:
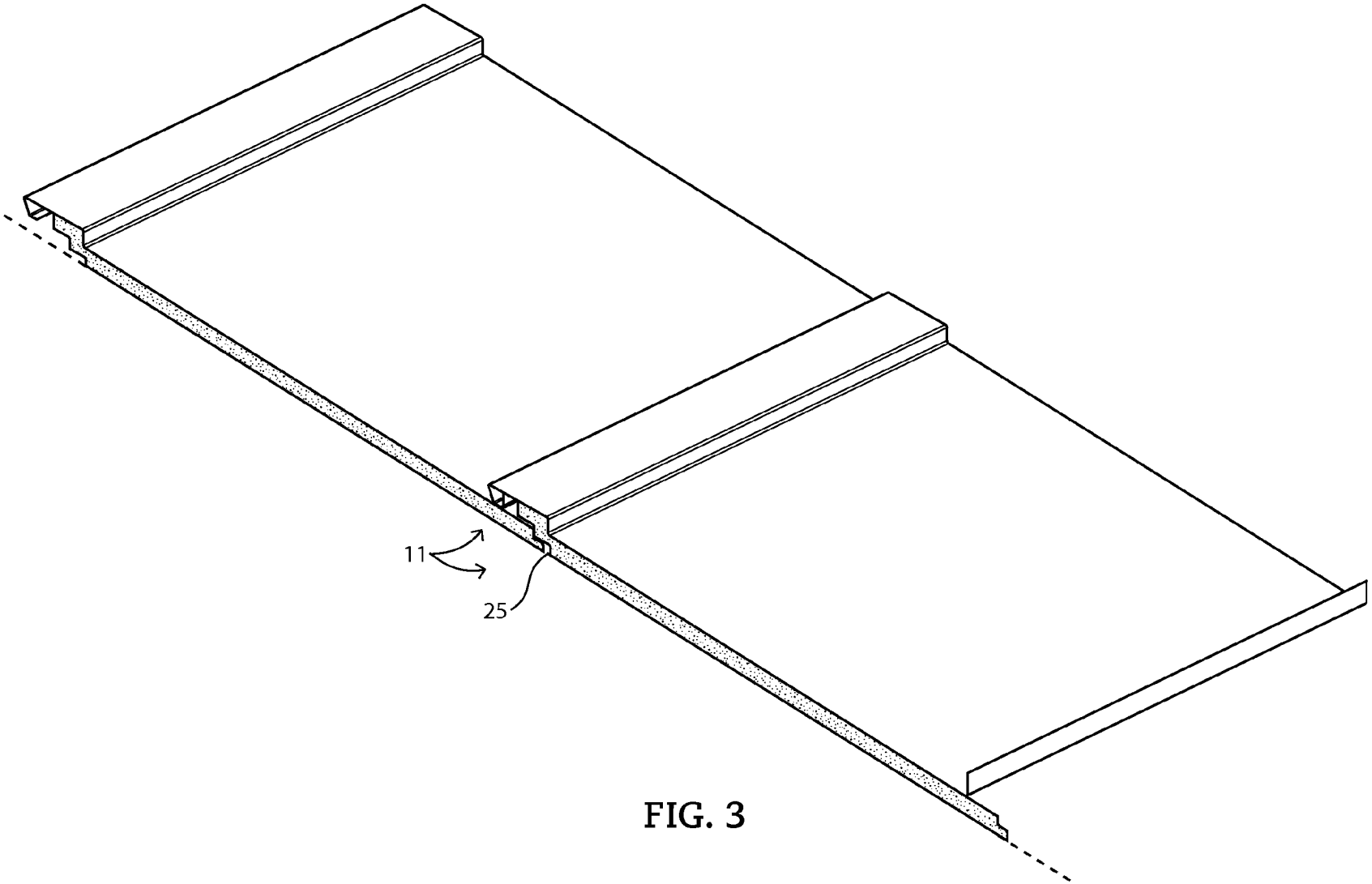
FIG. 3 is an isometric view of an embodiment of two siding panel products installed on a structure.

As shown in FIG. 2, the shell 13 may include lap joints 23 that are not mounted to the insulation layer 21. The lap joints 23 provide clearance to overlap an adjacent siding panel product 11 (FIG. 3). Siding panel products 11 are shown mounted to a support surface 25.

Some embodiments of foamback siding panel product 11 may comprise a shell 13 comprising a co-extruded, 3-layered structure. The structure may include a substrate 15 consisting of PVC sandwiched between inner and outer layers 17, 19. Each of the inner and outer layers 17, 19 may consist of ASA. In addition, at least the outer layer 19 may have a CIE color unit L*<60. An insulation layer 21 comprising a foam material may be mounted to the shell 13.

Embodiments of siding may comprise an exterior cladding for a structure such as a house, used for decoration and weatherproofing, as an alternative to traditional wood siding or other materials such as aluminum or fiber cement siding. Approximately 80% of the weight of some siding products is PVC resin, with the remaining 20% being composed of other ingredients that establish color, opacity, gloss, impact resistance, flexibility, and durability.

Some embodiments of siding panel products may be manufactured by co-extrusion. Two or more layers of material may be laid down in a continuous extrusion process. The top or outermost layer may comprise weatherable capstock, and may be about a third of the siding thickness. Capstock may include about 10% titanium dioxide, which is a pigment and provides resistance to breakdown from UV light. In some versions, the substrate may include about 15% ground limestone. The limestone reduces cost, and also balances the titanium dioxide, keeping both extrusion streams equally fluid during manufacturing. A small quantity of tin mercaptan or butadiene may be added as a stabilizer to chemically tie up any hydrochloric acid that is released into the PVC material as the siding ages. Lubricants also may be added to aid in the manufacturing process.

Embodiments of siding may comprise a wide range of product parameters, such as thickness. The siding also may include a UV coating applied to the surface of the product. The UV coating filters UV spectral light from the sun which would otherwise degrade the product more quickly.

Other embodiments of siding may include a partial fastening or locking system that is coupled with nails that to fasten the product to an exterior wall. The locking system can be a rolled lock or an extruded lock. The locking system may include a bottom lock that locks into either a start piece or onto the top lock of the panel below. The top lock may then be nailed to hold the panel to the wall. Such nailing can provide for float that is created by expansion and contraction from varying temperature and weather conditions. The siding may be configured to readily expand up, down, in and out, and left and right without restriction.

For hollow back siding products, darker colors may be available and generally do perform well in various types of climates. However, for foam backed or insulated siding, additional heat gain is expected and the balancing layer (e.g., ASA) on the back side addresses the issues at the laps and/or panel butt ends where there is no foam or adhesive to help the vinyl shell resist distortion.

Other embodiments may include one or more of the following items:

Item 1. A siding panel product, comprising:

a shell comprising a layered structure having a substrate comprising polyvinylchloride (PVC) located between inner and outer layers, wherein the inner and outer layers comprise acrylonitrile styrene acrylate (ASA);

at least the outer layer has a CIE color unit L*<75; and an insulation layer mounted to the shell.

Item 2. The siding panel product of claim 1, wherein the CIE color unit L*<60.

Item 3. The siding panel product of claim 1, wherein the CIE color unit L*<50.

Item 4. The siding panel product of claim 1, wherein the siding panel product has a vertical heat build up (HBU) of at least about 50° F.

Item 5. The siding panel product of claim 1, wherein the inner and outer layers have a glass transition temperature greater than the PVC substrate.

Item 6. The siding panel product of claim 1, wherein the inner and outer layers have a heat distortion temperature greater than the PVC substrate.

Item 7. The siding panel product of claim 1, wherein the outer layer has a thickness that differs from a thickness of the inner layer, or wherein the inner and outer layers each have a thickness that is substantially equal.

Item 8. The siding panel product of claim 1, wherein the outer layer is thicker than the inner layer.

Item 9. The siding panel product of claim 1, wherein the inner layer is thicker than the outer layer.

Item 10. The siding panel product of claim 1, wherein the outer layer has a thickness of about 0.003 inches to about 0.005 inches.

Item 11. The siding panel product of claim 1, wherein the inner layer has a thickness of about 0.0015 inches to about 0.0025 inches.

Item 12. The siding panel product of claim 1, wherein the shell has a total thickness of about 0.004 inches to about 0.060 inches, about 0.035 inches to about 0.050 inches, or about 0.042 inches to about 0.048 inches.

Item 13. The siding panel product of claim 1, wherein the inner layer is a film or a coating.

Item 14. The siding panel product of claim 1, wherein the inner layer has a thickness of about 0.001 inches to about 0.003 inches.

Item 15. The siding panel product of claim 1, wherein the inner layer is applied as a wet coating, and the wet coating dries to a dry thickness of about 0.001 inches to about 0.002 inches.

Item 16. The siding panel product of claim 1, wherein the outer layer is applied as a wet coating, and the wet coating dries to a dry thickness of about 0.001 inches to about 0.002 inches.

Item 17. The siding panel product of claim 1, wherein the shell has lap joints that are not mounted to the insulation layer.

Item 18. The siding panel product of claim 1, wherein the insulation layer comprises a foam material.

Item 19. The siding panel product of claim 1, wherein the shell is a 3-layered structure having no other layers.

Item 20. The siding panel product of claim 1, wherein the layered structure of the shell is co-extruded.

Item 21. A foamback siding panel product, comprising:

a shell comprising a co-extruded, 3-layered structure having a substrate consisting of polyvinylchloride (PVC) located between inner and outer layers, wherein each of the inner and outer layers consist of acrylonitrile styrene acrylate (ASA);

at least the outer layer has a CIE color unit L*<60; and an insulation layer comprising a foam material mounted to the shell.

Item 22. The foamback siding panel product of claim 21, wherein the CIE color unit L*<50.

Item 23. The foamback siding panel product of claim 21, wherein the foamback siding panel product has a vertical heat build up (HBU) of at least about 50° F.

Item 24. The foamback siding panel product of claim 21, wherein the inner and outer layers have a glass transition temperature greater than the PVC substrate.

Item 25. The foamback siding panel product of claim 21, wherein the inner and outer layers have a heat distortion temperature greater than the PVC substrate.

Item 26. The foamback siding panel product of claim 21, wherein the outer layer has a thickness that differs from a thickness of the inner layer, or wherein the inner and outer layers each have a thickness that is substantially equal.

Item 27. The foamback siding panel product of claim 21, wherein the outer layer is thicker than the inner layer.

Item 28. The foamback siding panel product of claim 21, wherein the inner layer is thicker than the outer layer.

Item 29. The foamback siding panel product of claim 21, wherein the outer layer has a thickness of about 0.003 inches to about 0.005 inches.

Item 30. The foamback siding panel product of claim 21, wherein the inner layer has a thickness of about 0.0015 inches to about 0.0025 inches.

Item 31. The foamback siding panel product of claim 21, wherein the shell has a total thickness of about 0.004 inches to about 0.060 inches, about 0.035 inches to about 0.050 inches, or about 0.042 inches to about 0.048 inches.

Item 32. The foamback siding panel product of claim 21, wherein the inner layer is a film or a coating.

Item 33. The foamback siding panel product of claim 21, wherein the inner layer has a thickness of about 0.001 inches to about 0.003 inches.

Item 34. The foamback siding panel product of claim 21, wherein the inner layer is applied as a wet coating, and the wet coating dries to a dry thickness of about 0.001 inches to about 0.002 inches.

Item 35. The foamback siding panel product of claim 21, wherein the outer layer is applied as a wet coating, and the wet coating dries to a dry thickness of about 0.001 inches to about 0.002 inches.

Item 36. The foamback siding panel product of claim 21, wherein the shell has lap joints that are not mounted to the insulation layer.

Item 37. A siding panel product, comprising:

a shell comprising a layered structure having a substrate comprising polyvinylchloride (PVC) located between inner and outer layers, wherein the inner and outer layers comprise a weatherable polymer;

at least the outer layer has a CIE color unit L*<75; and an insulation layer mounted to the shell.

Item 38. The siding panel product of claim 37, wherein the weatherable polymer comprises acrylonitrile styrene acrylate or poly(acrylic styrene acrylonitrile) (ASA), poly(acrylonitrile ethylene styrene) or poly(acrylonitrile ethylene propylene styrene) (AES), acrylic or polymethylmethacrylate (PMMA).

Item 39. A foamback siding panel product, comprising:

a shell comprising a co-extruded, 3-layered structure having a substrate consisting of polyvinylchloride (PVC) located between inner and outer layers, wherein each of the inner and outer layers consist of a weatherable polymer;

at least the outer layer has a CIE color unit L*<60; and an insulation layer comprising a foam material mounted to the shell.

Item 40. The foamback siding panel product of claim 39, wherein the weather polymer comprises acrylonitrile styrene acrylate or poly(acrylic styrene acrylonitrile) (ASA), poly (acrylonitrile ethylene styrene) or poly(acrylonitrile ethylene propylene styrene) (AES), acrylic or polymethylmethacrylate (PMMA).

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A siding panel product, comprising:

a shell comprising a layered structure having a substrate consisting of polyvinylchloride (PVC) located between inner and outer layers, wherein the inner and outer layers consist of acrylonitrile styrene acrylate (ASA);

at least the outer layer has a CIE color unit L*<75; and an insulation layer mounted to the shell.

2. The siding panel product of claim 1, wherein the CIE color unit L*<60.

3. The siding panel product of claim 1, wherein the CIE color unit L*<50.

4. The siding panel product of claim 1, wherein the siding panel product has a vertical heat build up (HBU) of at least about 50 degrees F.

5. The siding panel product of claim 1, wherein the inner and outer layers have a glass transition temperature greater than the PVC substrate.

6. The siding panel product of claim 1, wherein the inner and outer layers have a heat distortion temperature greater than the PVC substrate.

7. The siding panel product of claim 1, wherein the outer layer has a thickness of about 0.003 inches to about 0.005 inches.

8. The siding panel product of claim 1, wherein the inner layer has a thickness of about 0.0015 inches to about 0.0025 inches.

9. The siding panel product of claim 1, wherein the shell has a total thickness of about 0.004 inches to about 0.060 inches, about 0.035 inches to about 0.050 inches, or about 0.042 inches to about 0.048 inches.

10. The siding panel product of claim 1, wherein the inner layer is a coating.

11. The siding panel product of claim 1, wherein the inner layer has a thickness of about 0.001 inches to about 0.003 inches.

12. The siding panel product of claim 1, wherein the inner layer is applied as a wet coating, and the wet coating dries to a dry thickness of about 0.001 inches to about 0.002 inches.

13. The siding panel product of claim 1, wherein the outer layer is applied as a wet coating, and the wet coating dries to a dry thickness of about 0.001 inches to about 0.002 inches.

14. The siding panel product of claim 1, wherein the shell has lap joints that are not mounted to the insulation layer.

15. The siding panel product of claim 1, wherein the shell is a 3-layered structure having no other layers.

16. The siding panel product of claim 1, wherein the layered structure of the shell is co-extruded.

17. A siding panel product, comprising:

a foam insulation layer;

a shell bonded to the foam insulation layer, and the shell consists of three layers:

a substrate consisting of polyvinylchloride (PVC);

an inner layer consisting of acrylonitrile styrene acrylate (ASA); and an outer layer consisting of acrylonitrile styrene acrylate (ASA), and the outer layer has a CIE color unit L*<50; and the siding panel product has a vertical heat build up (HBU) of at least about 50 degrees F.

18. The siding panel product of claim 17, wherein the siding panel product is extruded, and the inner layer is a coating on the extruded siding panel product.

19. The siding panel product of claim 18, wherein the siding panel product is extruded, and the inner layer is applied as a wet coating on the extruded siding panel product, and the wet coating dries to a dry thickness of about 0.001 inches to about 0.002 inches.

20. The siding panel product of claim 17, wherein the siding panel product is extruded, and the outer layer is applied as a wet coating on the extruded siding panel product, and the wet coating dries to a dry thickness of about 0.001 inches to about 0.002 inches.

* * * * *